United States Patent [19]

Williams

[11] Patent Number: 5,013,273

[45] Date of Patent: May 7, 1991

[54] MULTIPURPOSE AQUATIC FLOTATION DEVICE

[76] Inventor: Daniel Williams, 2424 S. Dixie Hwy., Suite 200, Miami, Fla. 33133

[21] Appl. No.: 549,533

[22] Filed: Jul. 9, 1990

Related U.S. Application Data

[63] Continuation of Ser. No. 332,162, Apr. 3, 1989, abandoned.

[51] Int. Cl.[5] ..... B63B 35/74

[52] U.S. Cl. ..... 441/130; 297/118

[58] Field of Search ..... 441/35, 40, 129–131, 441/122, 113, 108; 272/1 B; 297/118, DIG. 3; 5/417, 448

[56] References Cited

U.S. PATENT DOCUMENTS 1,513,843 11/1924 Meffert ..... 441/108
1,532,970 4/1925 Walker ..... 441/113
2,338,535 1/1944 Pfleumer ..... 441/113
3,094,725 6/1963 Martin, Jr. ..... 441/113

FOREIGN PATENT DOCUMENTS 1476696 4/1967 France ..... 441/122

*Primary Examiner*—Sherman Basinger

[57] ABSTRACT

A flexible, multicellular, flotable, water-repellant mattress having opposite complementary end surfaces of similar shape and size; and means for detachably coupling the end surfaces together to form a toroidal shape with the mattress. The mattress has a length about three times its width, and may be an inflatable raft or a foam slab. The coupling means may be a means for lacing the end surfaces together, or interengaging fastener members, such as a zipper or Velcro fastener members. The novel mattress can be used flat or with the end surfaces coupled together in a multiplicity of uses on land or floating on the surface of a body of water.

12 Claims, 1 Drawing Sheet

MULTIPURPOSE AQUATIC FLOTATION DEVICE

This is a continuation of co-pending application Ser. No. 332,162 filed on Apr. 3, 1989, and now abandoned.

BACKGROUND OF THE INVENTION

1. Field of the Invention

This invention relates to a novel aquatic flotation device that can be used for many recreational purposes at a bathing beach or at a swimming pool. The novel device can be used flat for reclining on or for floating on, or it can be formed into a chair for sitting in on land or while floating on the surface of a body of water 2. Description of the Prior Art In the past, many different flotation mattresses have been proposed for use at a bathing beach or at a swimming pool. See, for example, U.S. Pat. Nos. 4,006,503; 4,138,753; and 4,451,240, all issued to R. L. Wood. Such prior flotation mattresses or beach pads may be inflatable multi-cell pads or closed-cell, water-repellant solid foam slabs. These prior devices are soft and comfortable when laid flat for sitting on or for reclining on. They can also be laid flat on a water surface and used for riding the waves, or floating on a gentle swell of the surface, or simply floating on quiet water.

However, these prior devices do not provide any back support when a person is sitting on them. Hence, bathers will bring one or more chairs to the beach or pool for sitting on in addition to the prior devices that are used for lying upon. This requires several items that must be remembered, assembled and hand-carried to and from a beach or pool.

It has also been proposed to provide a life-saving chair with a backrest which a person can sit in while the chair is floating on the surface of a body of water for example, as described in U.S. Pat. Nos. 238,741 issued to A. Wilson. Such a chair is not adapted for recreational use and is not convertible to a flotation mat for reclining on or lying on in a prone position.

OBJECT OF THE INVENTION

An object of this invention is to provide a novel flotation device that can be used for many purposes at a bathing beach or at a swimming pool.

Another obJect is to provide a novel flotation device that can be used for lying upon or for sitting in on land or when floating on the surface of a body of water.

A further object is to provide a novel flotation device that can be used for reclining upon as with prior flotation devices, and has novel means for converting it into a chair with a backrest.

Still another object is to provide a novel flotation device that can be formed into a chair with a backrest so that it can be sat on in different ways on land or while floating on the surface of a body of water.

SUMMARY OF THE INVENTION

The foregoing and other objects can be realized with the novel flotation device which comprises a flexible, multicellular, flotable, water-repellant mattress having opposite complementary end surfaces of similar shape and size; and means for detachably coupling the end surfaces together to form a toroidal shape with the mattress. The mattress has a length about three times the width thereof, and may be a multi-cell inflatable raft or a closed-cell solid foam slab. The coupling means may be a means for lacing the end surfaces together, or interengaging fastener members attached to the end surfaces, such as a zipper or a hook-and-loop (Velcro) fastener pair.

As with prior flotation mats, the novel device may be laid flat and a person can lie upon it in the prone position on land or while the device is floating on the surface of a body of water. If desired, the end surfaces can be coupled together with the coupling means to form a toroidal shape. The novel device in this shape can be placed with an open end facing up and sat in when the device is supported on land or while floating on water. If desired, the novel device with the end surfaces coupled together can be further altered in shape by bending a part of the toroidal wall downward to form a seat for a person while leaving another part of the toroidal wall in a substantially vertical position to act as a backrest for a seated person. The novel device in this further altered shape can be used as a chair on land or while floating on the surface of a body of water.

The novel device can be used for other purposes. For example, as a flotation mat with the ends coupled or uncoupled, it can be used for life-saving purposes on the surface of a body of water. Also, with the end surfaces coupled together, it can be used as a partial sunshade by placing it around a person's body. Since the coupling means is detachable, the device may be converted from one geometric form to another an unlimited number of times.

DETAILED DESCRIPTION OF THE INVENTION INCLUDING THE PREFERRED EMBODIMENT

Figure 1:
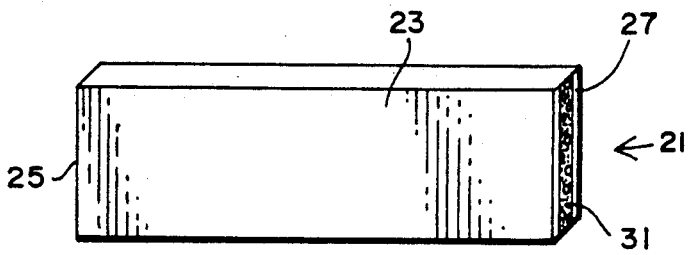
FIG. 1 is a perspective view of a first embodiment of the novel device, which employs hook-and-loop fasteners.

The following description of some of the preferred embodiments of the concepts of this invention is made in reference to the accompanying figures. Where an individual structural element is depicted in more than one figure, it is assigned a common reference numeral for simplification of identification and understanding.

The first embodiment 21 shown in FIG. 1 comprises a mattress 23 in the form of a substantially rectangular closed-cell solid foam slab about 72 inches long by about 24 inches wide by about 2 inches thick. The slab, because of its closed multicellular structure, is both water-repellant and flotable on water. It is also flexible.

There are many commerical materials which fulfill these characteristics, such as Ensolite foam marketed by Uniroyal, Mishawaka, Ind. Also, the mattress 23 can be provided in other sizes.

The foam slab 23 has two end surfaces 25 and 27 on which are attached interengaging fastener members 29 and 31 respectively in the form of hook-and-loop fastener members, which are also known as Velcro fasteners. The Velcro fastener members 29 and 31 are adhesively attached to the end surfaces 25 and 27 as shown with the front elevational view in FIG. 1 substantially the entire length of the end surfaces 25 and 27.

Figure 3:
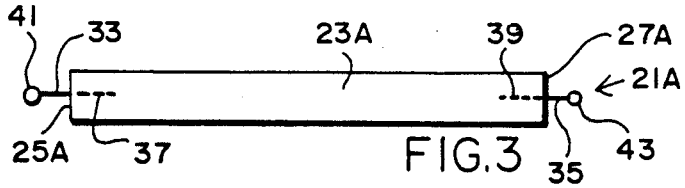
FIG. 3 is a front elevational view of a second embodiment of the novel device which employs a zipper fastener.

FIG. 3 shows a second embodiment 21A of the novel device, 23A, which is similar to the first embodiment except that zipper fastener members 33 and 35 substitute for the Velcro fastener members 29 and 31. The zipper fastener members 33 and 35 are attached by making a slit 37 and 39 in each of the end surfaces 25A and 27A, applying an adhesive to each of the walls of each of the slits 37 and 39, inserting the zipper supports into the slits 37 and 39 with the zipper teeth 41 and 43 respectively extending from the slits 37 and 39, and then curing the adhesive.

Figure 2:
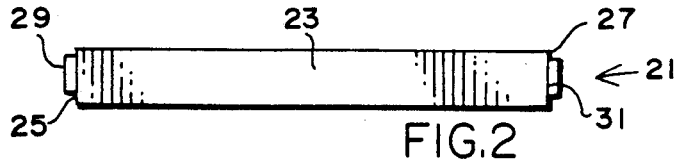
FIG. 2 is a front elevational view of the embodiment shown in FIG. 1.

The first and second embodiments 21 and 21A may be used flat as shown in FIGS. 2 and 3 respectively on land to sit on or lie on. Because of its foam character, each novel device 21 and 21A provides comfort as well as thermal insulation from the land on which it rests. Each novel device 21 and 21A can also be used as a floating raft on a water surface for a person to lie on quietly, or while surfing, or to assist in water safety, or life saving.

Figure 4:
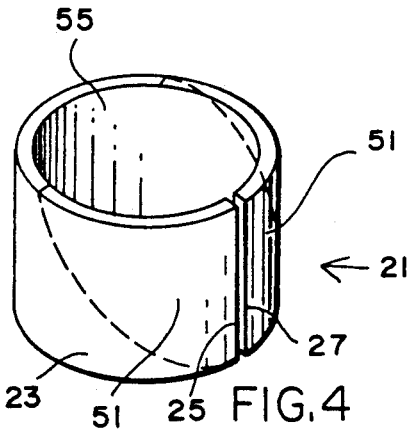
FIG. 4 is a perspective view of the first embodiment shown in FIG. 1 with the device formed into a toroidal shape by coupling together the end surfaces thereof.
Figure 5:
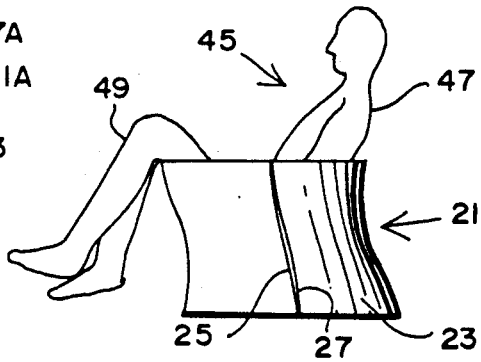
FIG. 5 is a side elevational view of the embodiment shown in FIG. 4 used as a seat by a person.

FIG. 4 shows another possible structural arrangement for the first embodiment shown in FIG. 2. In this arrangement, the end surfaces 25 and 27 are coupled together by the fastener members 29 and 31 to form a toroidal shape with the mattress 23. With an open end of the toroidal shape facing upward, a person 45 can sit in that open end with the torso 47 and legs 49 extending out of the toroidal shape as shown in FIG. 5. Since the mattress 23 is flexible, and the toroidal shape has some strength, the toroidal shape distorts somewhat under the weight of the person 45 to accommodate to the person's shape.

Although not shown, the toroidal shape shown in FIG. 4 can also be placed as a rug around the torso of a person. Either standing, sitting down or lying down, the toroidal shaped device can provide shade and protection from the sun and reflected light.

Figure 6:
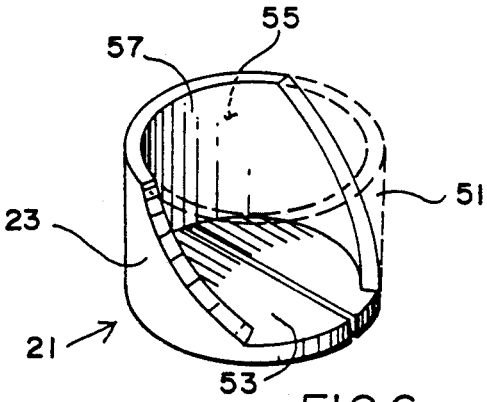
FIG. 6 is a perspective view of the embodiment shown in FIG. 4 further modified in shape to provide a seat with a backrest.
Figure 7:
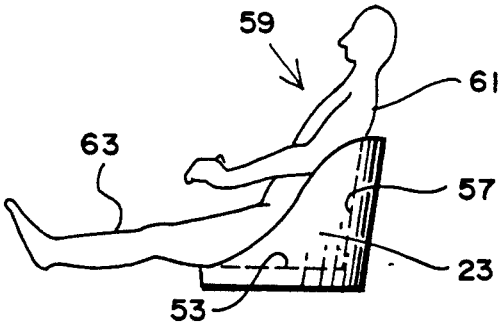
FIG. 7 is a side elevational view of the embodiment shown in FIG. 6 used as a seat by a person.

FIG. 6 shows another possible structural arrangement for the first embodiment shown in FIG. 2. Starting with the toroidal shape shown in FIG. 4, portion 51 of the mattress 23 is folded down into the lower open end of the toroidal structure to form a seat 53 and the remaining portion 55 of the mattress 23 forms a back rest 57. For this arrangement, it is important that the mattress 23 has a length that is about three times its width, so that the mattress's width fits comfortably inside the diameter of the toroidal structure. FIG. 7 shows a person 59 sitting comfortably in the seat 53 with his back 61 resting against the backrest 57 and his legs 63 extended. Since the mattress 23 is flexible, the shape distorts somewhat under the weight of the person 59 to accommodate to the person's shape.

Figure 8:
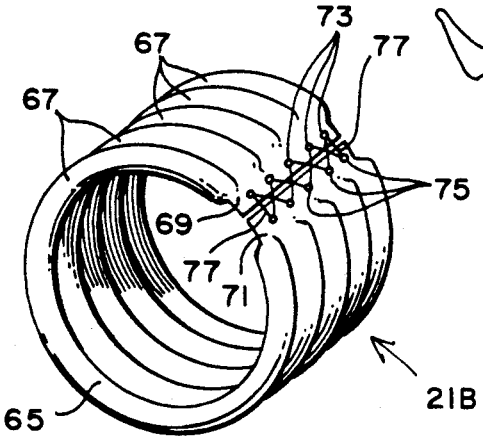
FIG. 8 is a perspective view of a third embodiment of the novel device comprising an inflatable multi-cell raft having lacing means for coupling together the end surfaces thereof.

FIG. 8 shows a third embodiment 21B of the novel device comprising a substantially rectangular, flexible, water-repellant mattress 65 having a multiplicity of cells 67 that are inflated with air or other gas. The mattress 65 has end surfaces in the form of end tabs 69 and 71, each of which has a plurality of lacing eyes 73 and 75 respectively therein. The mattress 65 of the third embodiment is normally flat and can be used in this planer form in the same manner as the first embodiment. As shown in FIG. 8, the end tabs 69 and 71 are coupled together with a lacing means comprising a lace or rope 77 which passes alternately through the lacing eyes 73 and 75, to produce a toroidal shape similar to the toroidal shape shown in FIG. 4.

Both the second and third embodiments 21A and 21B may be formed into the geometric shapes shown in FIGS. 4 and 6, and may be used in the same manner as the first embodiment 21, including the usages shown in FIGS. 5 and 7. In all of the embodiments, the novel device has a unique means for detachably coupling together the end surface a flotation mattress. The coupling means makes it possible to produce many geometric shapes which have many uses at a beach or at a pool. Since the novel device is made of flat material, it can be provided with snaps or other fasteners for forming the mattress into a carrying case for toting towels, etc. to and from a beach or pool.

The foregoing figures and descriptions thereof are provided as illustrative of some of the preferred embodiments of the concepts of this invention. While these embodiments represent what is regarded as the best modes for practicing this invention, they are not intended as limiting the scope of the invention, which is set forth in the following claims.

What is claimed is:

1. An aquatic flotation chair comprising a flexible, multi-cellular, floatable, water-repellant mattress having opposite complementary end surfaces of similar shape and size, said mattress having a length about three times the width thereof; and means for detachably coupling said end surfaces together to form a toroidal shape with said mattress having first and second open ends such that said first and second open ends are oriented such that they lie one above the other, each in a substantially horizontal plane, wherein said first and second open ends form an upper open end and a lower open end, whereby a portion of said upper end and a portion of said toroidal shape is folded downwardly substantially into said lower open end so as to form a seat, and whereby a portion of said toroidal shape not folded downwardly forms a backrest for said seat.

2. The device define din claim 1 wherein said mattress is a multi-cell inflatable raft and said coupling means comprises means for lacing said ends together.

3. The device defined in claim 1 wherein said mattress is a closed-cell solid foam slab and said coupling means comprises interengaging complementary fastening members attached to said end surfaces.

4. The device defined in claim 3 wherein said coupling means comprises at least one hook-and-loop fastener pair.

5. The device defined in claim 3 wherein said coupling means comprises a zipper fastener.

6. An aquatic flotation chair comprising a flexible, multi-cellular, floatable, water-repellant, substantially-rectangular mattress having opposite complementary end surfaces of similar width, said mattress having a length about three times the width thereof; and means for detachably coupling said end surfaces in substantial registration with respect to one another along substantially the entire length of said end surfaces, whereby to form a toroidal shape with said mattress having first and second open ends such that said first and second open ends are oriented such that they lie one above the other, each in a substantially horizontal plane, wherein said first and second open ends form an upper open end and a lower open end, whereby a portion of said upper end and a portion of said toroidal shape is folded downwardly substantially into said lower open end so as to form a seat, and whereby a portion of said toroidal shape not folded downwardly forms a backrest for said seat.

7. The flotation device defined in claim 6 wherein said mattress comprises a multi-cell inflatable raft having a tab at each of the ends of said mattress, and said coupling means includes lacing eyes in each of said tabs and means for lacing together said ends using said lacing eyes.

8. The flotation device defined in claim 6 wherein said mattress comprises a closed-cell, solid foam slab having substantially rectangular end surfaces and a thickness substantially less than said width.

9. The flotation device defined in claim 8 wherein said coupling means comprises interengaging fastening members physically attached to said end surfaces.

10. The flotation device, defined in claim 9 wherein said coupling means comprises a hook-and-loop fastener pair attached to said end surfaces.

11. The flotation device defined in claim 9 wherein said coupling means comprises a zipper fastener attached to said end surfaces.

12. A method for forming a chair from an aquatic flotation device comprising a flexible, multi-cellular, floatable, water-repellant mattress having opposite complementary end surfaces of similar shape and size, said mattress having a length about three times the width thereof; said method comprising detachably coupling said end surfaces together to form a toroidal shape with said mattress such that said toroidal shape has first and second open ends, orienting said toroidal shape such that said first open end and said second open end lie one above the other, each in a substantially horizontal plane, wherein said first and said second open ends form an upper open end and a lower open end, folding a portion of said upper open end and a portion of said toroidal shape downwardly substantially into said lower open end so as to form a seat, and leaving a portion of said toroidal shape unfolded so as to form a backrest for said seat.

* * * * *